US007611015B2

(12) United States Patent
Chang

(10) Patent No.: US 7,611,015 B2
(45) Date of Patent: Nov. 3, 2009

(54) ELECTRICAL CONNECTOR ASSEMBLY WITH PROTECTING MEMBER

(75) Inventor: Chun-Yi Chang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/002,744

(22) Filed: Dec. 18, 2007

(65) Prior Publication Data

US 2008/0146045 A1 Jun. 19, 2008

(30) Foreign Application Priority Data

Dec. 18, 2006 (CN) ..... 2006 1 0166438

(51) Int. Cl.
*B65D 85/00* (2006.01)

(52) U.S. Cl. ..... 206/701

(58) Field of Classification Search ..... 439/135, 439/940, 41; 206/701, 722
See application file for complete search history.

(56) References Cited

U.S. PATENT DOCUMENTS

| | | | | | |
|---|---|---|---|---|---|
| 193,382 | A * | 7/1877 | Pinney et al. | 40/661.04 |
| 1,658,496 | A * | 2/1928 | Qvarnstrom | 206/39 |
| 4,113,098 | A * | 9/1978 | Howard | 206/540 |
| 4,173,281 | A * | 11/1979 | Trought | 206/5.1 |
| 4,284,204 | A * | 8/1981 | Carey, Jr. | 220/345.3 |
| 4,620,632 | A * | 11/1986 | Alemanni | 206/724 |
| 4,846,345 | A * | 7/1989 | Hamuro et al. | 206/701 |
| 4,898,276 | A * | 2/1990 | Georgakis | 206/369 |
| 5,275,291 | A * | 1/1994 | Sledge | 206/531 |
| 5,507,657 | A * | 4/1996 | Seto et al. | 439/135 |
| 6,047,829 | A * | 4/2000 | Johnstone et al. | 206/531 |
| 6,120,303 | A * | 9/2000 | Tung | 439/41 |
| 6,146,152 | A * | 11/2000 | McHugh et al. | 439/66 |
| 6,276,563 | B1 * | 8/2001 | Saldana et al. | 221/154 |
| 6,349,831 | B1 * | 2/2002 | Buss | 206/531 |
| 6,789,677 | B2 * | 9/2004 | Maietta | 206/536 |
| 6,796,805 | B2 * | 9/2004 | Murr | 439/71 |
| 6,840,777 | B2 * | 1/2005 | Sathe et al. | 439/65 |
| 6,848,577 | B2 * | 2/2005 | Kawamura et al. | 206/449 |
| 6,875,022 | B2 * | 4/2005 | Ma | 439/41 |
| 6,905,353 | B2 * | 6/2005 | Ma et al. | 439/135 |
| 6,974,331 | B2 * | 12/2005 | Brown et al. | 439/66 |
| 7,093,736 | B2 * | 8/2006 | Maietta et al. | 221/3 |
| 7,134,554 | B2 * | 11/2006 | Achammer et al. | 206/725 |
| 2001/0013483 | A1 * | 8/2001 | Konno et al. | 206/706 |
| 2004/0043642 | A1 * | 3/2004 | Lin | 439/70 |

(Continued)

*Primary Examiner*—T C Patel
*Assistant Examiner*—Vladimir Imas
(74) *Attorney, Agent, or Firm*—Andrew C. Cheng; Wei Te Chung; Ming Chieh Chang

(57) ABSTRACT

An electrical connector assembly (1) comprises an insulative housing (2) having opposite upper and lower surfaces, a plurality of contacts received in the insulative housing, and a protecting member (4) comprising opposite upper and lower plates (42, 44) parallel to each other and at least one connecting section (431, 432, 433) connecting the upper and lower plates. The upper and lower plates define a receiving space (40) therebetween and an opening (400) communicating with the receiving space and outside. The insulative housing is slidrably inserted into the receiving space of the protecting member from the opening and received in the receiving space of the protecting member with the upper and lower surfaces thereof are covered by the upper and lower plates of the protecting member.

2 Claims, 5 Drawing Sheets

U.S. PATENT DOCUMENTS

2004/0166703 A1* 8/2004 McHugh et al. ..... 439/71
2005/0090126 A1* 4/2005 Achammer et al. ..... 439/71
2005/0208813 A1* 9/2005 Trout et al. ..... 439/326
2007/0054514 A1* 3/2007 Long et al. ..... 439/70
2007/0054531 A1* 3/2007 Tang et al. ..... 439/326
2007/0102381 A1* 5/2007 Nguy et al. ..... 211/70.6
2007/0293088 A1* 12/2007 Hiew et al. ..... 439/610
2008/0060975 A1* 3/2008 Young et al. ..... 206/745

* cited by examiner

ELECTRICAL CONNECTOR ASSEMBLY WITH PROTECTING MEMBER

CROSS-REFERENCE TO RELATED APPLICATIONS

This application is related to U.S. patent application entitled "ELECTRICAL CONNECTOR ASSEMBLY WITH IMPROVED PICK UP CAP", which has the same assignee as the present invention.

BACKGROUND OF THE INVENTION

1. Field of the Invention

The present invention generally relates to an electrical connector assembly, and more particularly to an electrical connector assembly for removably mounting a chip module, such as a Central Processing Unit (CPU), to a printed circuit board.

2. Description of Related Art

U.S. Pat. No. 6,875,022, issued on Apr. 5, 2005 and U.S. Pat. No. 6,905,353, both assigned to HonHai, disclose an electrical connector assembly for electrically connecting a chip module to a printed circuit board. The electrical connector assembly comprises an insulative housing, a plurality of contacts received in the insulative housing, and a pick-up cap covering an upper surface of the insulative housing. The insulative housing defines a plurality of contact-receiving slots penetrating through upper and lower surfaces thereof. The contacts are received in the contact-receiving slots and have upper and lower contacting surfaces. The insulative housing is displaced on the printed circuit board to form electrical connection between the lower contacting surfaces of the contacts with the printed circuit board. Then the chip module is placed on the upper surface of the insulative housing to form electrical connection with the upper contacting surfaces of the contacts. Thus, the electrical connection between the chip module and the printed circuit board is realized.

The pick-up cap is latchably assembled to the upper surface of the insulative housing. The pick-up cap can be sucked by a vacuum mechanism to realize the movement of the electrical connector and covers the upper surface of the insulative housing to prevent dust from outside or damage made to upper contacting surfaces of the contacts. However, the electrical connector assembly with such structure has the shortcomings as follows: The pick-up cap only covers the upper surface of the insulative housing to protect the upper contacting surfaces of the contacts. The lower contacting surfaces of the contacts are not protected which are prone to be damaged or dusted during the movement of the insulative housing and the contacts.

Therefore, it is desired to provide an improved electrical connector assembly to stress the problems mentioned above.

BRIEF SUMMARY OF THE INVENTION

Accordingly, an object of the present invention is to provide an electrical connector assembly with improved structure for providing complete protection to contacts thereof.

In order to achieve the above-mentioned object, an electrical connector assembly comprises an insulative housing having opposite upper and lower surfaces, a plurality of contacts received in the insulative housing, and a protecting member comprising opposite upper and lower plates parallel to each other and at least one connecting section connecting the upper and lower plates. The upper and lower plates define a receiving space therebetween and an opening communicating with the receiving space and outside. The insulative housing is slidrably inserted into the receiving space of the protecting member from the opening and received in the receiving space of the protecting member with the upper and lower surfaces thereof are covered by the upper and lower plates of the protecting member.

Other objects, advantages and novel features of the invention will become more apparent from the following detailed description of the present embodiment when taken in conjunction with the accompanying drawings.

DETAILED DESCRIPTION OF THE INVENTION

Figure 1:
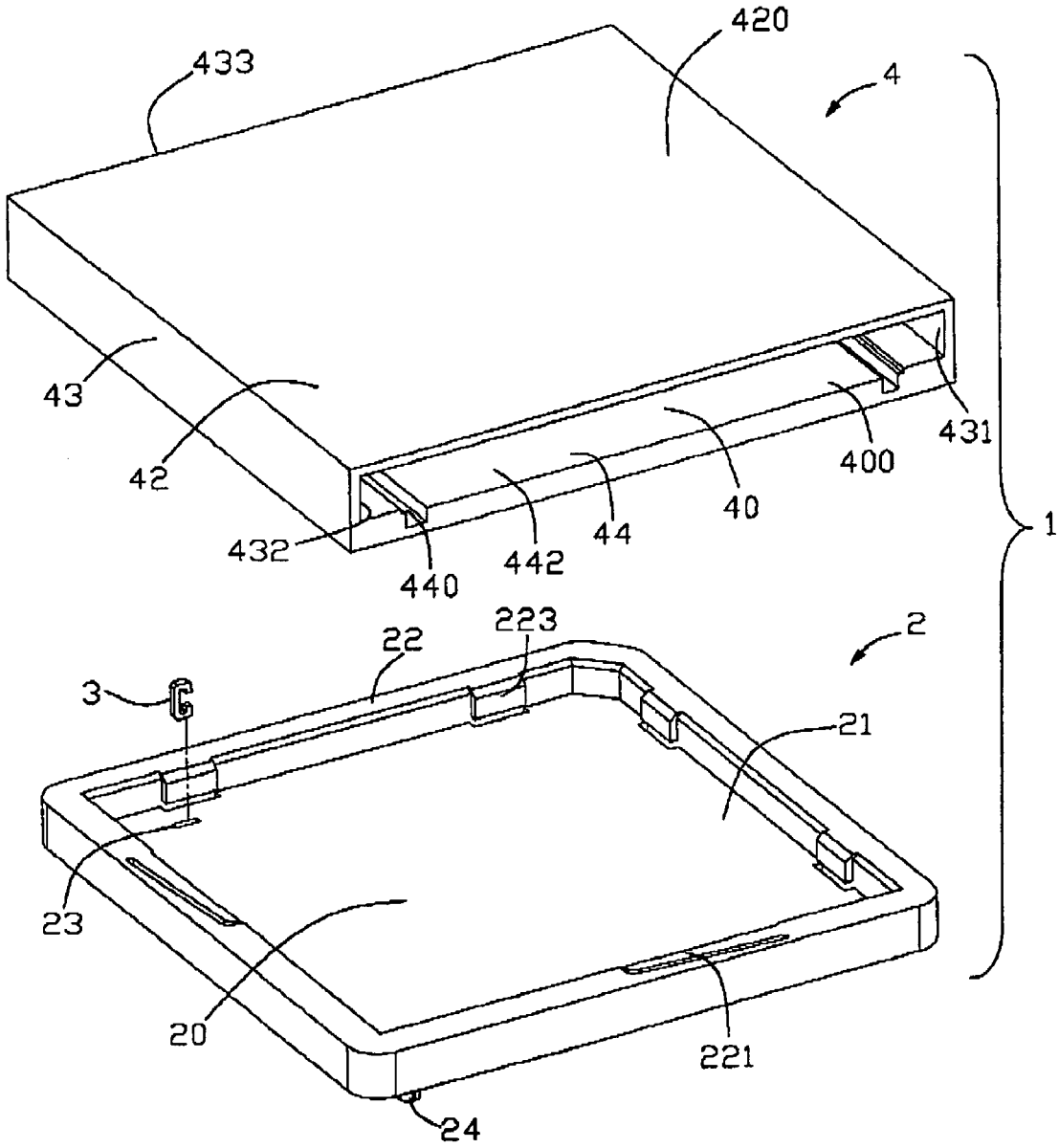
FIG. 1 is an exploded, perspective view of an electrical connector assembly in accordance with the preferred embodiment of the present invention.
Figure 2:
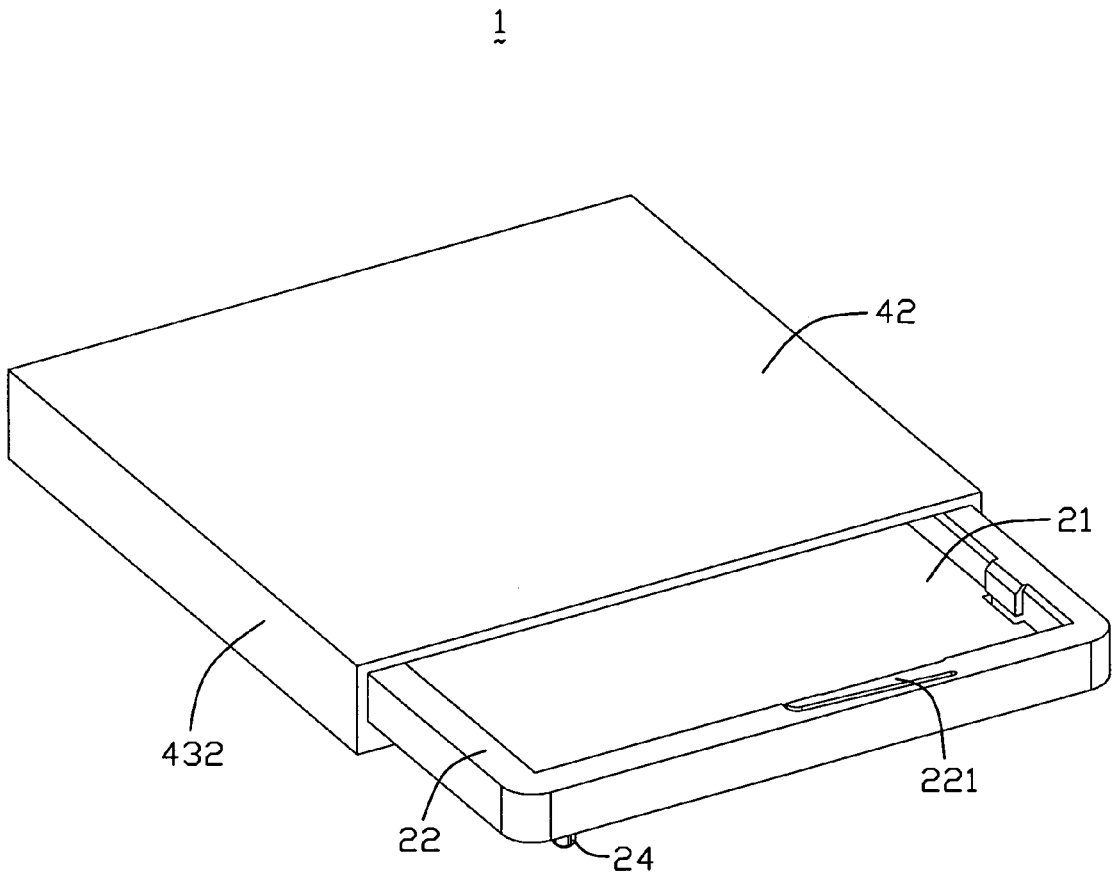
FIG. 2 is a partially assembled view of FIG. 1.
Figure 3:
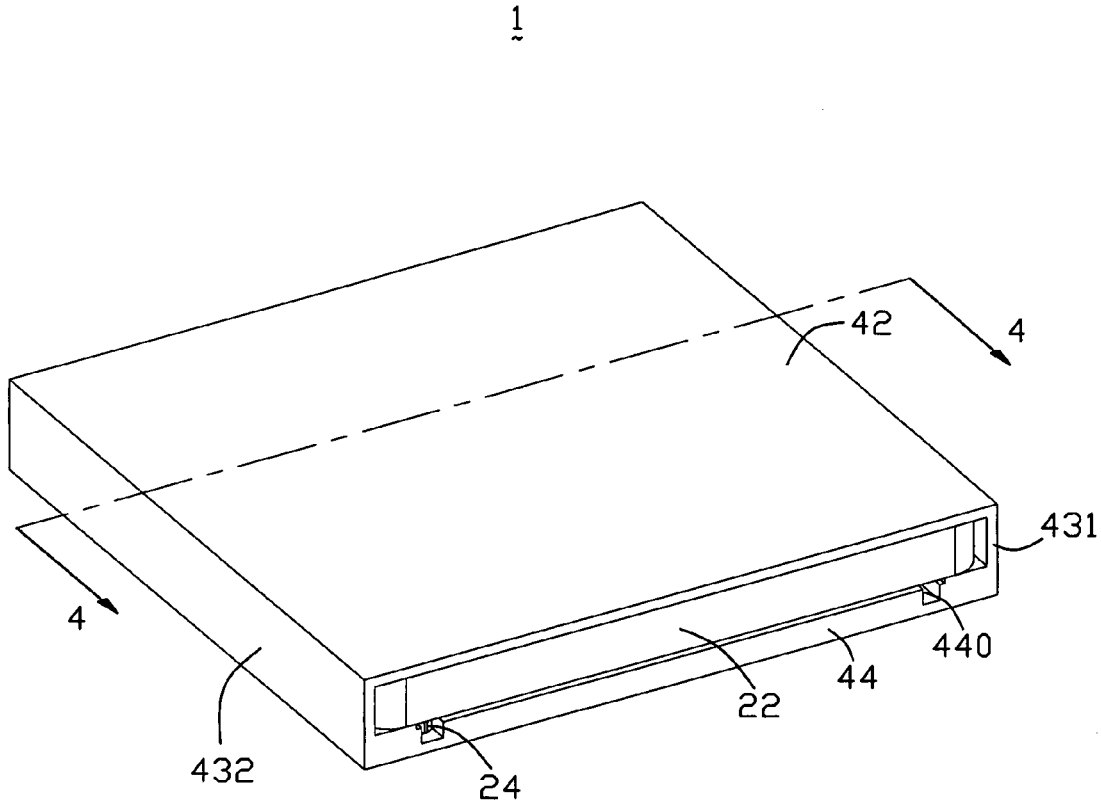
FIG. 3 is an assembled, perspective view of the electrical connector assembly of FIG. 1.
Figure 4:
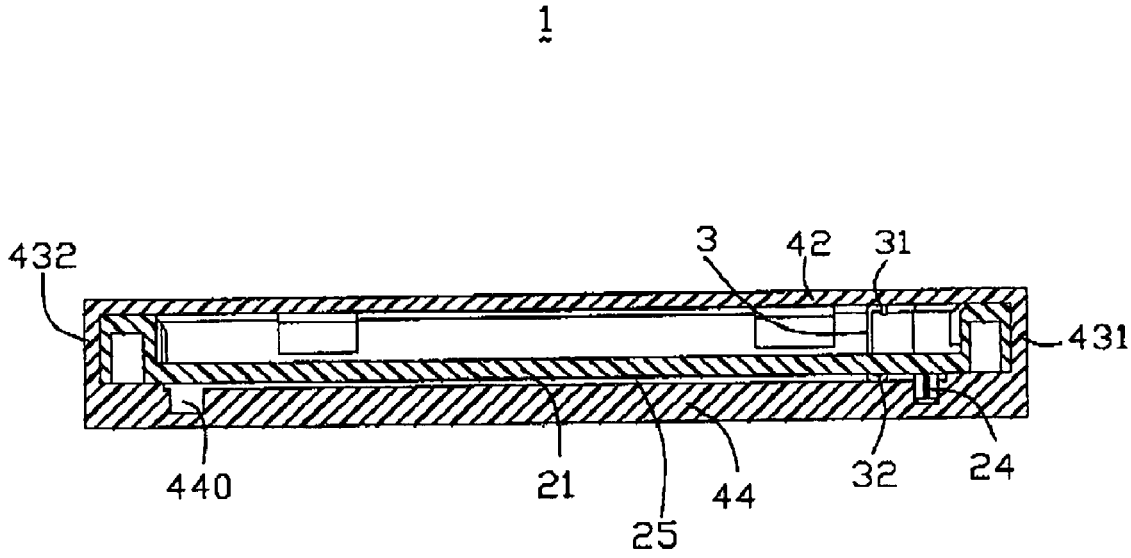
FIG. 4 is a cross-section view taken along line 4-4 of FIG. 3.

Reference will now be made to the drawing figures to describe the present invention in detail.

Please refer to FIGS. 1-4, an electrical connector assembly 1 in accordance with the preferred embodiment of the present invention is for electrically connecting a chip module (not shown), such as a Central Processing Unit (CPU), with a printed circuit board (PCB, not shown). The electrical connector assembly 1 comprises an insulative housing 2, a plurality of contacts 3 (only one is shown) accommodated in the insulative housing 2, and a protecting member 4 removably assembled to the insulative housing 2. In the preferred embodiment of the present invention, the electrical connector is a Land Grid Array connector.

The insulative housing 2 is substantially rectangular and comprises a main portion 21 and four sidewalls 22 extending upwardly from the main portion 21. A receiving space 20 is circumscribed by the main potion 21 and the sidewalls 22 for accommodating the chip module. A plurality of contact-receiving passages 23 are defined through upper and lower surfaces of the main portion 21 to receive the contacts therein. Two adjacent sidewalls 22 form a pair of spring arms 221 splitting therefrom to face the receiving space 20 for elastically abutting against the chip module. The other two sidewalls 22 each forms a pair of projections 223 aligning with each other to serve as a datum for the chip module. At least a pair of posts 24 depend downwardly from the lower surface of the insulative housing 2 for positioning the insulative housing 2 relative to the printed circuit board. The posts 24 can be parts of the insulative housing 2 and formed integrally with the insulative housing 2 or separate members assembled to the insulative housing 2. Usually, the posts 24 are arranged along a diagonal line of the insulative housing 2.

Each contact 3 comprises upper and lower contacting surfaces 31, 32 respectively exposed beyond upper and lower surfaces of the insulative housing 2.

The protecting member 4 is a rectangular frame defining a rectangular receiving passage 40 corresponding to outer periphery of the insulative housing 2 with a front opening 400 communicating with outside. The receiving passage 40 is defined by upper plate 42 covering upper surface of the insulative housing 2, opposite lower plate 44 covering lower surface of the insulative housing 2 and thicker than the upper plate 42, opposite vertical first and second connecting sections 431, 432 connecting with the upper and lower plates 42, 44 and a rear third connecting section 433' connecting with the upper and lower plates 42, 44 and the first and second connecting sections 431, 432 to seal the receiving passage 40. The first, second and third connecting sections 431, 432, 433 are all located in vertical planes and form a connecting portion 43. The front opening 400 is circumscribed by the upper and lower plates 42, 44 and the first and second connecting sections 431, 432. The upper surface 442 of the lower plate 44 is slotted with a pair of guiding slots 440 at opposite lateral sides thereof to permit the posts 24 of the insulative housing 2 to slide along the guiding slots 440 for facilitating the insertion of the insulative housing 2 into the protecting member 4. The upper surface 420 of the upper plate 42 is smooth for being sucked by a vacuum suction device (not shown). In the preferred embodiment of the present invention, the upper and lower plates 42, 44 and the connecting portion 43 are molded integrally. However, in an alternative embodiment, the members 42, 43, 44 also can be molded respectively and assembled to one another to form the receiving passage 40.

In assembly, the insulative housing 2 with the contacts 3 assembled therewith is inserted into the receiving passage 40 of the protecting member 4 from the opening 400. The posts 24 are inserted into and slide along the guiding slots 440 until one sidewall 22 of the insulative housing 2 abuts against the inner surface of the third connecting section 433. Thus, the upper surface of the insulative housing 2 is covered by and contacts the upper plate 42, and the outer surfaces of three sidewalls 22 contact the first, second and third connecting sections 431, 432, 433 with the other one sidewall 22 exposed outside from the opening 400. While, the lower surface of the insulative housing 2 is parallel to the inner surface 442 of the lower plate 44 with a first distance therebetween to form a lower receiving space 25 for accommodating the exposed lower contacting surfaces of the contacts. The receiving space 20 of the insulative housing 2 is sealed by the upper plate 42 of the protecting member 4 with the upper contacting surfaces of the contacts are exposed therein. Therefore, upper and lower contacting surfaces 31, 32 of the contacts 3 are protected by the upper and lower plates 42, 44 of the protecting member 4 from being dusted and damaged from outside.

Figure 5:
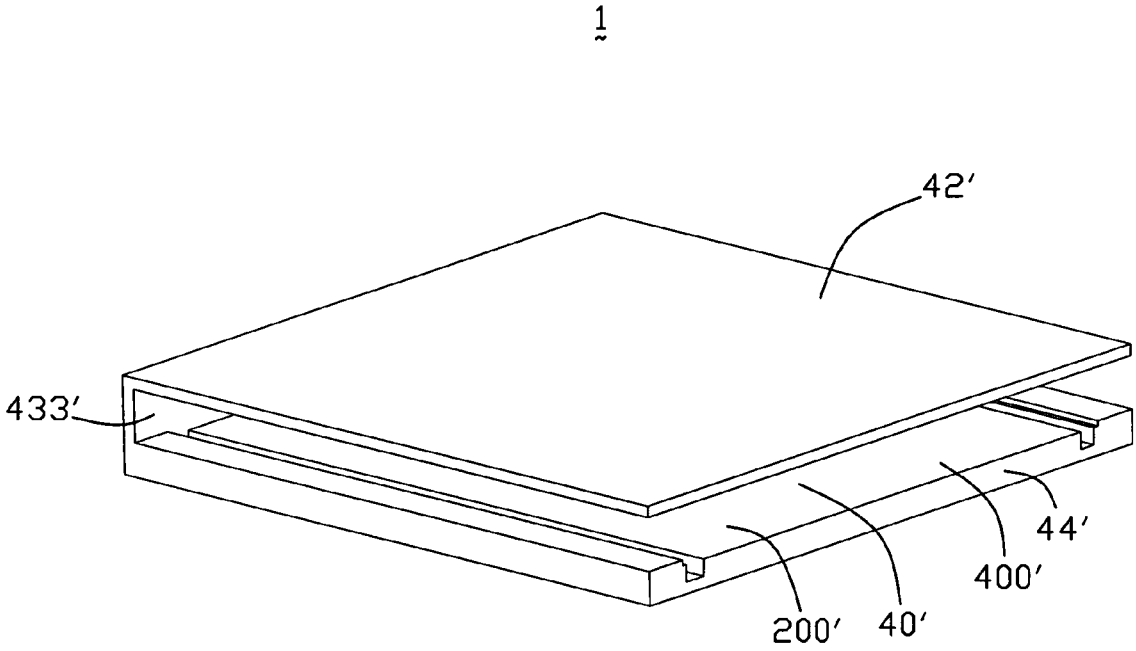
FIG. 5 is a perspective view of a protecting member in accordance with another embodiment of the present invention.

Please refer to FIG. 5, another protecting member 4' in accordance with another embodiment of the present invention is illustrated. The protecting member 4' is of inverted U-shape and comprises opposite upper and lower plates 42', 44' and a connecting section 433' corresponding to the third connecting section 433 of the first embodiment connecting rear edges of the upper and lower plates 42', 44'. However, the only one connecting section 433' also can be arranged to connect side edges of the upper and lower plates 42', 44'. That is, the connecting section 433' may face the opening 400' or does not face the opening 400'. Of course, a pair of connecting sections also can be arranged to connect the upper and lower plates 42', 44' which does not breach the spirit of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative housing having opposite upper and lower surfaces;

a protecting member comprising opposite upper and lower plates parallel to each other and commonly defining a receiving space therebetween, and an opening communicating the receiving space with an exterior in a transverse direction; and a plurality of conductive contacts disposed in the housing and upwardly exposed to the receiving space; wherein the insulative housing is slidably inserted into the receiving space of the protecting member from the opening and received in the receiving space of the protecting member with the upper and lower surfaces thereof being covered by the upper and lower plates of the protecting member; wherein a post formed on the lower surface of the housing adapted to fit into a corresponding through hole in a printed circuit board on which the housing is seated, extends below a top face of the lower plate; wherein said post performs a guiding function during insertion of the housing into the receiving space: wherein said post is located around a corner of the housing, and another post similar to said post, formed on the lower surface around another corner diagonal to said post and dimensioned to be fit into another corresponding through hole in said printed circuit board on which the housing is seated, extends below said top face of the lower plate.

2. An electrical connector assembly comprising:

an insulative housing having opposite upper and lower surfaces;

a protecting member comprising opposite upper and lower plates parallel to each other and commonly defining a receiving space therebetween, and an opening communicating the receiving space with an exterior in a transverse direction; and a plurality of conductive contacts disposed in the housing and upwardly exposed to the receiving space; wherein the insulative housing is slidably inserted into the receiving space of the protecting member from the opening and received in the receiving space of the protecting member with the upper and lower surfaces thereof being covered by the upper and lower plates of the protecting member; wherein a post formed on the lower surface of the housing adapted to fit into a corresponding through hole in a printed circuit board on which the housing is seated, extends below a top face of the lower plate; wherein said post performs a guiding function during insertion of the housing into the receiving space; wherein the top face of the lower plate of the protecting member is formed with a guiding slot which extends in said transverse direction and into which the post extends under a condition that a diameter of the post is much smaller than a longitudinal dimension of said guiding slot.

* * * * *